US006055748A

United States Patent [19]

Harrison

[11] Patent Number: 6,055,748

[45] Date of Patent: May 2, 2000

[54] SHOE ANTI-SLIP ATTACHMENT

[76] Inventor: Kenneth R. Harrison, 3560 Pine Grove Ave. Suite 275, Port Huron, Mich. 48060

[21] Appl. No.: 09/231,371

[22] Filed: Jan. 14, 1999

[51] Int. Cl.[7] ..... A43C 15/00

[52] U.S. Cl. ..... 36/59 R

[58] Field of Search ..... 36/59 R, 59 B, 36/7.6, 7.7; 152/208

[56] References Cited

U.S. PATENT DOCUMENTS

| | | |
|---|---|---|
| 1,747,603 | 2/1930 | Ruth . |
| 2,408,152 | 9/1946 | Porcelli . |
| 2,472,331 | 6/1949 | Koehler . |
| 2,732,065 | 1/1956 | Marchese . |
| 3,561,140 | 2/1971 | Ludwig . |
| 3,903,620 | 9/1975 | Gillet . |
| 4,334,566 | 6/1982 | Augustine . |
| 4,702,021 | 10/1987 | Cameron . |
| 5,836,091 | 11/1998 | Cook . |

OTHER PUBLICATIONS

Alsto's Handy Helpers Catalog, 1997, p. 26.
Safety Zone Catalog, 1995, p. 23.
Safety Zone Catalog, 1995, p. 21.
Miles Kimball Catalog, 1995, p. 49.
Harriet Carter Catalog, 1995, p. 22.
Walter Drake Catalog, 1996, p. 19.

*Primary Examiner*—Ted Kavanaugh

[57] ABSTRACT

A shoe anti-slip attachment for attachment to the sole of a shoe to prevent a wearer from slipping on a surface the user is traversing. The shoe anti-slip attachment includes a plurality of flexible traction strips each having a pair of opposite surfaces, and an outer periphery. Each of the traction strips has an adhesive on a first of the faces of the respective traction strip. The traction strips each have a roughened surface on a second of the faces of the respective traction strip to frictionally enhance contact between the second face of each traction strip and a surface in contact with the second face of the respective traction strip.

8 Claims, 2 Drawing Sheets

SHOE ANTI-SLIP ATTACHMENT

BACKGROUND OF THE INVENTION

1. Field of the Invention

The present invention relates to shoe anti-slip attachments and more particularly pertains to a new shoe anti-slip attachment for attachment to the sole of a shoe to prevent a wearer from slipping on a surface the user is traversing.

2. Description of the Prior Art

The use of shoe anti-slip attachments is known in the prior art. More specifically, shoe anti-slip attachments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 4,160,331 by Bell; U.S. Pat. No. 5,259,125 by Gromes; U.S. Pat. No. 2,640,283 by McCord; U.S. Pat. No. 2,142,242 by Greenbaum; U.S. Pat. No. Des. 299,285 by Watson; and U.S. Pat. No. 4,558,542 by Marton.

While these devices fulfill their respective, particular objectives and requirements, the aforementioned patents do not disclose a new shoe anti-slip attachment. The inventive device includes a plurality of flexible traction strips each having a pair of opposite surfaces, and an outer periphery. Each of the traction strips has an adhesive on a first of the faces of the respective traction strip. The traction strips each have a roughened surface on a second of the faces of the respective traction strip to frictionally enhance contact between the second face of each traction strip and a surface in contact with the second face of the respective traction strip.

In these respects, the shoe anti-slip attachment according to the present invention substantially departs from the conventional concepts and designs of the prior art, and in so doing provides an apparatus primarily developed for the purpose of attachment to the sole of a shoe to prevent a wearer from slipping on a surface the user is traversing.

SUMMARY OF THE INVENTION

In view of the foregoing disadvantages inherent in the known types of shoe anti-slip attachments now present in the prior art, the present invention provides a new shoe anti-slip attachment construction wherein the same can be utilized for attachment to the sole of a shoe to prevent a wearer from slipping on a surface the user is traversing.

The general purpose of the present invention, which will be described subsequently in greater detail, is to provide a new shoe anti-slip attachment apparatus and method which has many of the advantages of the shoe anti-slip attachments mentioned heretofore and many novel features that result in a new shoe anti-slip attachment which is not anticipated, rendered obvious, suggested, or even implied by any of the prior art shoe anti-slip attachments, either alone or in any combination thereof.

To attain this, the present invention generally comprises a plurality of flexible traction strips each having a pair of opposite surfaces, and an outer periphery. Each of the traction strips has an adhesive on a first of the faces of the respective traction strip. The traction strips each have a roughened surface on a second of the faces of the respective traction strip to frictionally enhance contact between the second face of each traction strip and a surface in contact with the second face of the respective traction strip.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shoe anti-slip attachment apparatus and method which has many of the advantages of the shoe anti-slip attachments mentioned heretofore and many novel features that result in a new shoe anti-slip attachment which is not anticipated, rendered obvious, suggested, or even implied by any of the prior art shoe anti-slip attachments, either alone or in any combination thereof.

It is another object of the present invention to provide a new shoe anti-slip attachment which may be easily and efficiently manufactured and marketed.

It is a further object of the present invention to provide a new shoe anti-slip attachment which is of a durable and reliable construction.

An even further object of the present invention is to provide a new shoe anti-slip attachment which is susceptible of a low cost of manufacture with regard to both materials and labor, and which accordingly is then susceptible of low prices of sale to the consuming public, thereby making such shoe anti-slip attachment economically available to the buying public.

Still yet another object of the present invention is to provide a new shoe anti-slip attachment which provides in the apparatuses and methods of the prior art some of the advantages thereof, while simultaneously overcoming some of the disadvantages normally associated therewith.

Still another object of the present invention is to provide a new shoe anti-slip attachment for attachment to the sole of a shoe to prevent a wearer from slipping on a surface the user is traversing.

Yet another object of the present invention is to provide a new shoe anti-slip attachment which includes a plurality of flexible traction strips each having a pair of opposite surfaces, and an outer periphery. Each of the traction strips has an adhesive on a first of the faces of the respective traction strip. The traction strips each have a roughened surface on a second of the faces of the respective traction strip to frictionally enhance contact between the second face of each traction strip and a surface in contact with the second face of the respective traction strip.

Still yet another object of the present invention is to provide a new shoe anti-slip attachment that may also be attached to the tread of a tire to provide additional traction to the tire.

Even still another object of the present invention is to provide a new shoe anti-slip attachment that may come in a variety of shapes when marketed to children.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
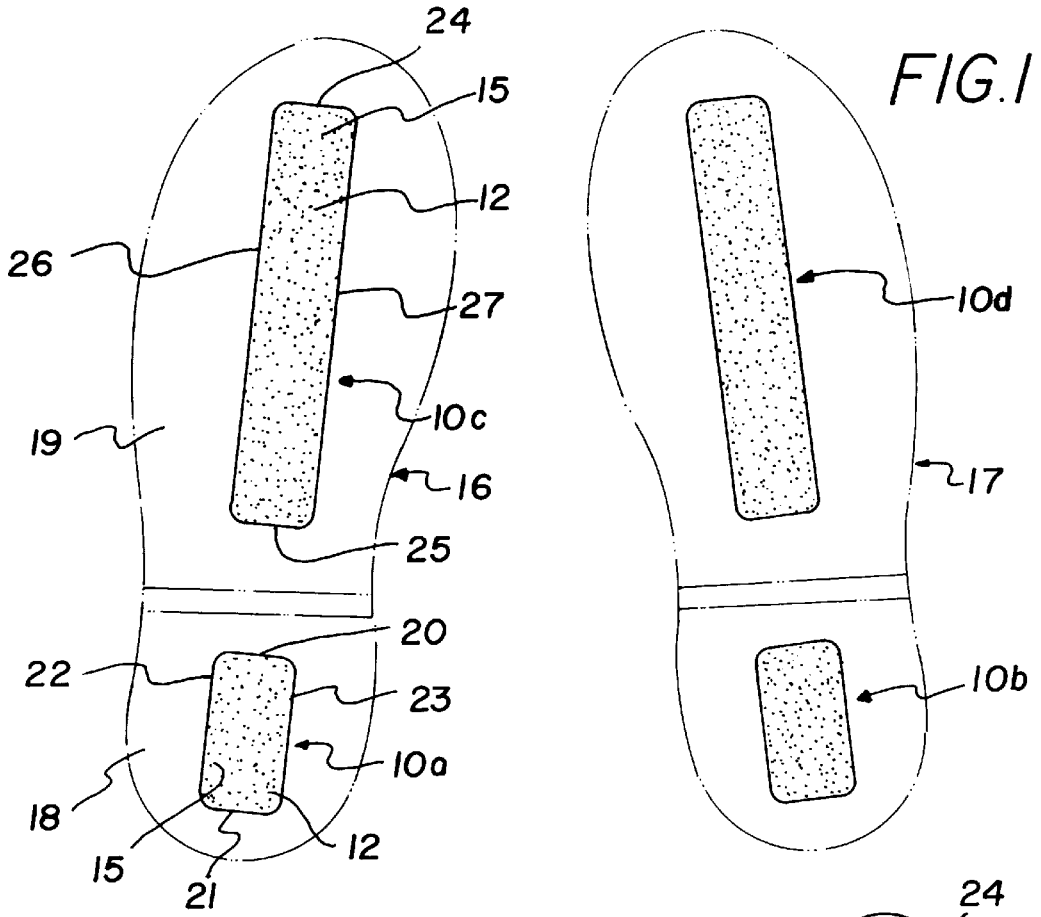
FIG. 1 is a schematic plan view of a new shoe anti-slip attachment according to the present invention.

With reference now to the drawings, and in particular to FIGS. 1 through 5 thereof, a new shoe anti-slip attachment embodying the principles and concepts of the present invention will be described.

As best illustrated in FIGS. 1 through 5, the shoe anti-slip attachment generally comprises a plurality of flexible traction strips each having a pair of opposite surfaces, and an outer periphery. Each of the traction strips has an adhesive on a first of the faces of the respective traction strip. The traction strips each have a roughened surface on a second of the faces of the respective traction strip to frictionally enhance contact between the second face of each traction strip and a surface in contact with the second face of the respective traction strip.

In closer detail, the traction enhancing system comprises a plurality of flexible traction strips 10 each having a pair of opposite surfaces 11,12, and an outer periphery. Each of the traction strips has an adhesive 13 on a first of the faces 11 of the respective traction strip. Preferably, the adhesive of each traction strip is substantially coextensive with the first face of the respective traction strip.

Figure 2:
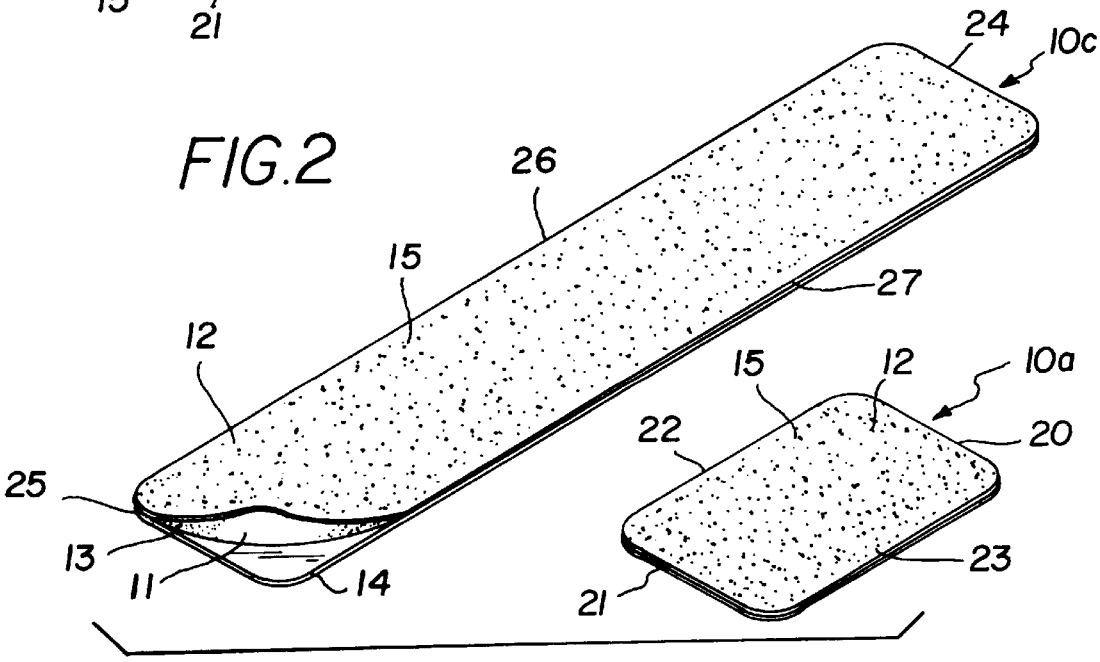
FIG. 2 is a schematic perspective view of a heel traction strip and a ball traction strip of the present invention.

Ideally, the traction strips each have a flexible backing 14 adhesively coupled to the adhesive on the first face of the respective traction strip as shown in FIG. 2. The flexible backings each are preferably substantially coextensive with the associated first face of the respective traction strip. In use, the flexible backings are detachable (by peeling) from the associated first face of the respective traction strip without excess residue of the adhesive remaining attached to the flexible backings to permit adhesive attachment of the first faces of the traction strips to surface once the flexible backings are removed.

The traction strips each have a roughened surface 15 on a second of the faces 12 of the respective traction strip. The roughened surfaces of the traction strips frictionally enhance contact between the second faces of the traction strips and a surface in contact with the second face of the traction strips. Preferably, the roughened surface of each traction strip is substantially coextensive with the second face of the respective traction strip. Ideally, the roughened surfaces of the traction strips comprises particulate adhesively bonded to the second face of the respective traction strip such as silica particulate of the type used in providing the roughened surface of sandpaper.

In a first embodiment use, a pair of shoes 16,17 are provided each having a sole for engaging a ground surface as illustrated in FIG. 1. The soles each have opposite heel and toe ends, a heel portion 18 adjacent the heel end of the respective sole, and a ball portion 19 adjacent the toe end of the respective sole. In this preferred embodiment, the traction strips comprise a pair of heel traction strips 10*a*,10*b* and a pair of ball traction strips 10*c*,10*d*.

With reference to FIGS. 1 and 2, the outer perimeters of the heel traction strips each are generally rectangular in shape and comprise a pair of generally straight and substantially parallel end edges 20,21 and a pair of generally straight and substantially parallel side edges 22,23 extending substantially perpendicular to the end edges of the respective heel traction strip. The adhesive of a first of the heel traction strips adhesively couples the first face of the first heel traction strip to the heel portion of the sole of a first of the shoes. Similarly, the adhesive of a second of the heel traction strips adhesively couples the first face of the second heel traction strip to the heel portion of the sole of a second of the shoes. The outer perimeters of the ball traction strips each are also generally rectangular in shape and comprise a pair of generally straight and substantially parallel end edges 24,25 and a pair of generally straight and substantially parallel side edges 26,27 extending substantially perpendicular to the end edges of the respective ball traction strip. The adhesive of a first of the ball traction strips adhesively couples the first face of the first ball traction strip to the ball portion of the sole of a first of the shoes. The adhesive of a second of the ball traction strips adhesively couples the first face of the second ball traction strip to the ball portion of the sole of a second of the shoes.

The heel and ball traction strips each have a length defined between the end edges of the respective traction strip and a width defined between the side edges of the respective traction strip. Preferably, the length of a heel traction strip is about one-fourth the length of a ball traction strip. Ideally, the length of each heel traction strip is about 1 inch, and the length of each ball traction strip is about 4 inches. The width of a heel traction strip is preferably about equal to the width of a ball traction strip. Ideally, the widths of the heel and ball traction strips are each about 1 inch.

In use, the heel and ball traction strips frictionally enhance contact between the associated sole and the ground surface that the wearer is traversing to enhance the traction between the sole and the ground surface help reduce the chance the wearer slipping on the ground surface. Ideally, the side edges of the first heel and ball traction strips on the sole of the first shoe are extended substantially parallel to one another and the side edges of the second heel and ball traction strips on the sole of the second shoe are extended substantially parallel to one another to optimally enhance frictional contact between the associated sole and a ground surface as the user is traversing the ground surface in a forwardly direction.

Figure 3:
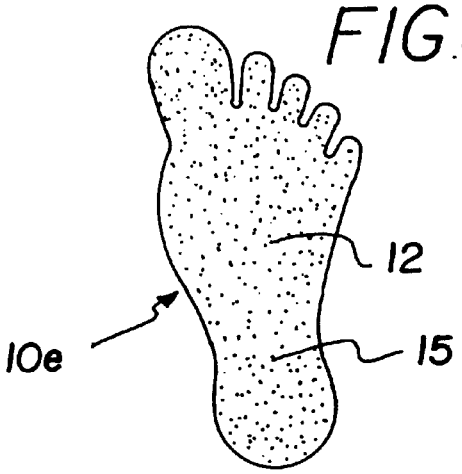
FIG. 3 is a schematic plan view of a foot shaped traction strip embodiment of the present invention.
Figure 4:
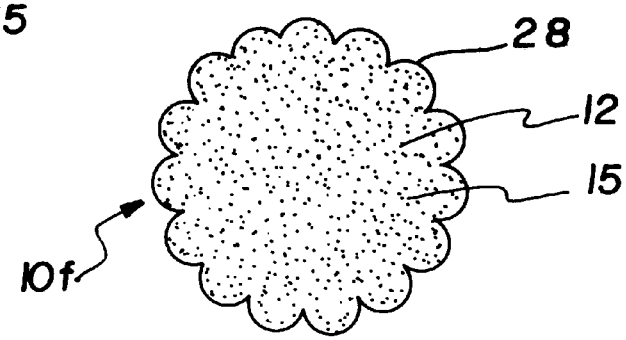
FIG. 4 is a schematic plan view novelty shaped traction strip embodiment of the present invention.

FIG. 3 illustrates a foot-shaped embodiment 10*e* of the traction strip having an outer perimeter of the foot-shaped traction strip shaped to resemble a human foot. FIG. 4 illustrates a novelty-shaped embodiment 10*f* of the traction strip having a generally circular outer perimeter with a plurality of generally arcuate lobes 28 therearound each having an outwardly facing convexity for aiding a child to grip a portion of the traction strip when peeling the novelty-shaped traction strip off of the sole of the child's shoe.

Figure 5:
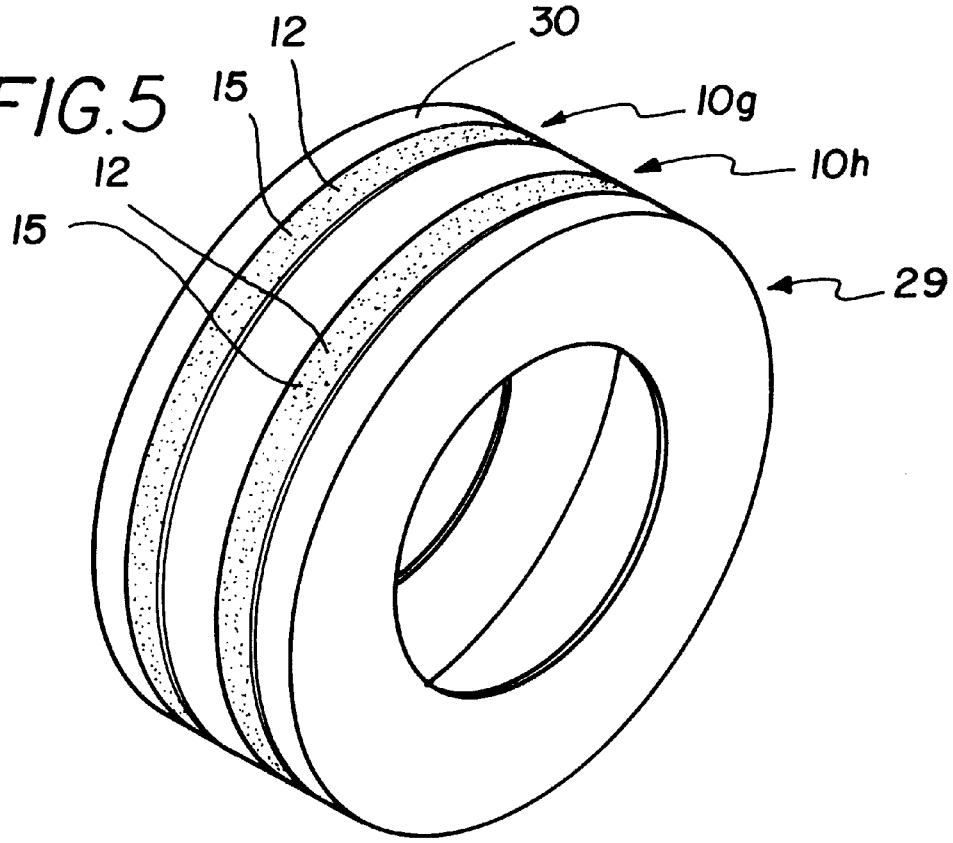
FIG. 5 is a schematic perspective view of an annular traction strip embodiment of the present invention in use on a tire.

FIG. 5 illustrates another embodiment of the traction strips for use with a tire has a spaced apart pair of side walls and a treaded portion extending between the side walls. In this embodiment, the traction strips comprising a pair of annular traction strips 10*g*,10*h* disposed around the treaded portion of the tire to frictionally enhance contact between the treaded portion and a road surface so that traction between the tire and the road surface is enhanced to help reduce the likelihood of the tire slipping on a road surface. The adhesives of the annular traction strips adhesively couple the first faces of the annular traction strips to the treaded portion of the tire.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A traction enhancing system, comprising:

a plurality of flexible traction strips each having a pair of opposite surfaces, and an outer periphery;

each of said traction strips having an adhesive on a first of said faces of the respective traction strip;

each of said traction strips having a roughened surface on a second of said faces of the respective traction strip, said roughened surfaces of said traction strips frictionally enhancing contact between said second faces of said traction strips and a surface in contact with said second face of said traction strips;

each of said traction strips having a flexible backing adhesively coupled to said adhesive on said first face of the respective traction strip, said flexible backing each being substantially coextensive with the associated first face of the respective traction strip, said flexible backings being detachable by peeling from the associated first face of the respective traction strip; and wherein the outer periphery of each of said traction strips is generally rectangular in shape and comprising a pair of generally straight and substantially parallel end edges and a pair of generally straight and substantially parallel side edges extending substantially perpendicular to said end edges, a corner edge positioned between each of the side edges and one of the end edges to form a corner, said corner edges each having an arcuate shape between said side and end edges to form a radius corner profile for resisting peeling of the traction strip from a sole of a shoe when the sole contacts a ground surface.

2. The traction enhancing system of claim 1, further comprising a pair of shoes each having a sole for engaging a ground surface, said soles each having opposite heel and toe ends, a heel portion adjacent said heel end of the respective sole, and a ball portion adjacent said toe end of the respective sole, said sole of each of said shoes having said first face of at least one of said traction strips coupled thereto.

3. The traction enhancing system of claim 2, wherein said traction strips comprise a pair of heel traction strips, said adhesive of a first of said heel traction strips adhesively coupling said first face of said first heel traction strip to said heel portion of said sole of a first of said shoes, said adhesive of a second of said heel traction strips adhesively coupling said first face of said second heel traction strip to said heel portion of said sole of a second of said shoes.

4. The traction enhancing system of claim 3, wherein said traction strips further comprises a pair of ball traction strips, said adhesive of a first of said ball traction strips adhesively coupling said first face of said first ball traction strip to said ball portion of said sole of a first of said shoes, said adhesive of a second of said ball traction strips adhesively coupling said first face of said second ball traction strip to said ball portion of said sole of a second of said shoes.

5. The traction enhancing system of claim 4, wherein said heel and ball traction strips each have a length defined between said end edges of the respective traction strip and a width defined between said side edges of the respective traction strip, wherein said length of a heel traction strip is about one-fourth said length of a ball traction strip, and wherein said width of a heel traction strip is about equal to said width of a ball traction strip.

6. The traction enhancing system of claim 5, wherein said side edges of said first heel and ball traction strips on said sole of said first shoe are extended substantially parallel to one another, and wherein said side edges of said second heel and ball traction strips on said sole of said second shoe are extended substantially parallel to one another.

7. The traction enhancing system of claim 1, wherein said adhesive of each traction strip is substantially coextensive with said first face of the respective traction strip.

8. A traction enhancing system, comprising:

a pair of shoes each having a sole for engaging a ground surface, said soles each having opposite heel and toe ends, a heel portion adjacent said heel end of the respective sole, and a ball portion adjacent said toe end of the respective sole;

a plurality of flexible traction strips each having a pair of opposite surfaces, and an outer periphery;

each of said traction strips having an adhesive on a first of said faces of the respective traction strip, said adhesive of each traction strip being substantially coextensive with said first face of the respective traction strip;

said traction strips each having a roughened surface on a second of said faces of the respective traction strip, said roughened surfaces of said traction strips frictionally enhancing contact between said second faces of said traction strips and a surface in contact with said second face of said traction strips;

said roughened surface of each traction strip being substantially coextensive with said second face of the respective traction strip;

wherein said roughened surfaces of said traction strips comprises particulate adhesively bonded to said second face of the respective traction strip;

said traction strips comprising a pair of heel traction strips, said outer peripheries of said heel traction strips each being generally rectangular in shape and comprising a pair of generally straight and substantially parallel end edges and a pair of generally straight and substantially parallel side edges extending substantially perpendicular to said end edges of the respective heel traction strip, a corner edge positioned between each of the side edges and one of the end edges to form a corner, said corner edges each having an arcuate shape between said side and end edges to form a radius corner profile for resisting peeling of the traction strip from the sole of said shoe when the sole contacts a ground surface;

said adhesive of a first of said heel traction strips adhesively coupling said first face of said first heel traction strip to said heel portion of said sole of a first of said shoes;

said adhesive of a second of said heel traction strips adhesively coupling said first face of said second heel traction strip to said heel portion of said sole of a second of said shoes;

said traction strips further comprising a pair of ball traction strips, said outer peripheries of said ball traction strips each being generally rectangular in shape and comprising a pair of generally straight and substantially parallel end edges and a pair of generally straight and substantially parallel side edges extending substantially perpendicular to said end edges of the respective ball traction strip, a corner edge positioned between each of the side edges and one of the end edges to form a corner, said corner edges each having an arcuate shape between said side and end edges to form a radius corner profile for resisting peeling of the traction strip from the sole of said shoe when the sole contacts a ground surface;

said adhesive of a first of said ball traction strips adhesively coupling said first face of said first ball traction strip to said ball portion of said sole of a first of said shoes;

said adhesive of a second of said ball traction strips adhesively coupling said first face of said second ball traction strip to said ball portion of said sole of a second of said shoes;

said heel and ball traction strips each having a length defined between said end edges of the respective traction strip and a width defined between said side edges of the respective traction strip;

said length of a heel traction strip being about one-fourth said length of a ball traction strip, wherein said length of each heel traction strip is about 1 inch, and wherein said length of each ball traction strip is about 4 inches;

said width of a heel traction strip being about equal to said width of a ball traction strip, wherein said widths of said heel and ball traction strips are each about 1 inch;

said side edges of said first heel and ball traction strips on said sole of said first shoe being extended substantially parallel to one another; said side edges of said second heel and ball traction strips on said sole of said second shoe being extended substantially parallel to one another.

* * * * *